United States Patent [19]

Faulstich

[11] 3,940,004

[45] Feb. 24, 1976

[54] WIDEMOUTH JAR NECK AND PLASTIC CAP CONSTRUCTION

[75] Inventor: George W. Faulstich, San Carlos, Calif.

[73] Assignee: Three Sisters Ranch Enterprises, San Carlos, Calif.

[22] Filed: Oct. 15, 1974

[21] Appl. No.: 514,599

[52] U.S. Cl. ..... 215/256; 215/31; 215/320

[51] Int. Cl.[2] ..... B65D 41/48

[58] Field of Search ..... 150/.5; 215/253, 254, 255, 215/256, 320, 321, 31

[56] References Cited

UNITED STATES PATENTS

| | | | |
|---|---|---|---|
| 3,367,524 | 2/1968 | Lake | 215/256 |
| 3,608,765 | 9/1971 | Faulstich | 215/256 |
| 3,622,028 | 11/1971 | Lohrer | 215/253 |
| 3,672,528 | 6/1972 | Faulstich | 215/256 |

*Primary Examiner*—Donald F. Norton
*Attorney, Agent, or Firm*—Julian Caplan

[57] ABSTRACT

A widemouth (e.g. 120 mm) jar preferably of plastic material has a neck having a flexible in-turned flange at its upper end and two vertically spaced, horizontal inward-formed beads with two outward-downward conical surfaces above and below the lower inward-formed beads. The cap has a top disk with a depending short inner skirt having a tapered edge and an elongated peripheral skirt. The peripheral skirt has in consecutive order proceeding downward an upper cylindrical portion, an upper internal bead, a circumferential internal weakening groove, a lower locking bead and a slanted ramp. The in-turned flange of the neck is compressed between the two cap skirts, the upper internal bead seats against the upper conical surface and the locking bead seats in the lower inward-formed bead of the neck. Thus a product and air-tight multi-zone seal is effected; and, further, once seated the cap is tamper-proof in that it must be torn to be removed. To tear the cap, a tear tab depends from the skirt and two upward slanted internal weakening grooves are formed to either side of the tear tab connecting to the circumferential weakening groove. The portion of the cap above the groove is used for reclosure and may be lifted by a second tab depending from the cap skirt adjacent the tear tab.

4 Claims, 5 Drawing Figures

WIDEMOUTH JAR NECK AND PLASTIC CAP CONSTRUCTION

This application is an improvement on U.S. Pat. No. 3,608,765.

This invention relates to a new and improved widemouthed jar and neck and plastic cap construction. More particularly, a principal feature of the invention relates to an improved seal between the jar neck and cap which provides a seal in three zones and enables the seal to remain effective even under severe stress.

One feature of the improved construction is the formation of an in-turned flexible lip on the top edge of the neck which provides an improved seal between the inner and outer skirts of the cap.

Another improved feature of the construction is the provision of an upper in-turned bead on the neck which forms a seal with the inner skirt of the cap. Still another improvement in the construction of the cap is the deepening of the lower internal bead or locking ring of the neck and of the cap to form a more secure, tamperproof construction prior to tearing of the cap.

Pressure of the contents of the jar forces the inner skirt of the cap into more firm contact with the upper bead of the neck and also forces the neck outward into more firm engagement with the upper bead of the cap. Hence under stress from the pressure of the contents a more firm seal is accomplished.

Other features of the invention relate in the tamperproof characteristics of the seal in that the bottom of the skirt must be torn off. The bottom edge of the skirt of the cap, prior to tearing, seats immediately above and in contact with the lower outer bead of the neck making it difficult to pry the cap off the neck.

Still another feature of the construction is the fact that the skirts of the caps are provided with slanted or ramp surfaces which cooperate with surfaces of the neck to facilitate installation of the cap by merely downward pressure on the cap, preferably mechanically applied.

Other objects of the present invention will become apparent upon reading the following specification and referring to the accompanying drawings in which similar characters of reference represent corresponding parts in each of the several views.

Figure 1:
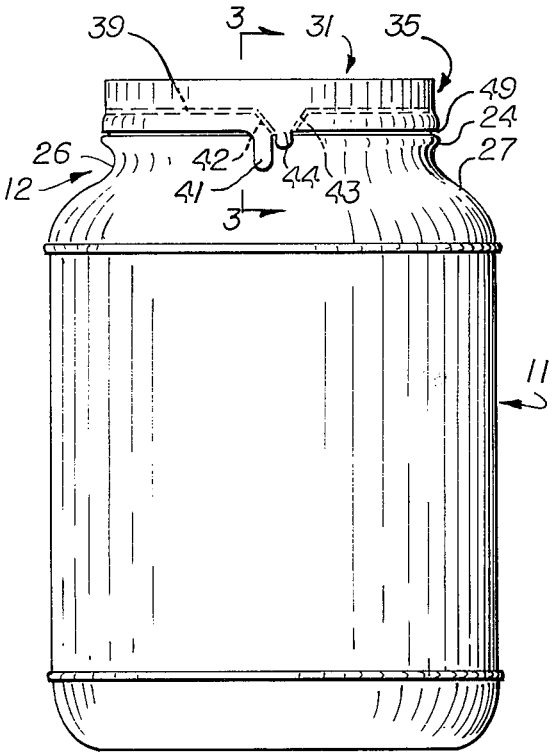
FIG. 1 is a side elevational view showing the cap of the present invention installed on the jar.
Figure 2:
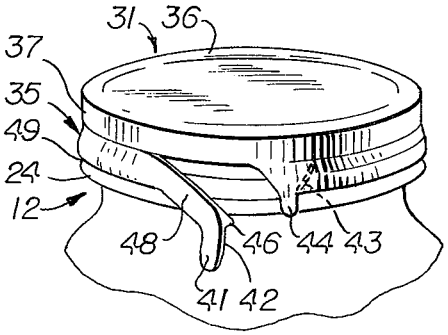
FIG. 2 is a fragmentary perspective view of the upper portion of the structure of FIG. 1 showing the tear strip partially severed from the cap.

As has been stated, the present invention is an improvement on the structure shown in U.S. Pat. No. 3,608,765, the features of improvement being emphasized in the following description. Jar 11 is preferably formed of polyethylene or polystyrene but also may be of glass, although it is desirable that a plastic material be used since it is flexible. Jar 11 has a wide-mouthed neck 12 of a diameter of about 120 mm. and in the form shown in FIG. 1 is a construction desirable for packing salad dressings, mayonnaise, peanut butter and a variety of other materials. At the upper end or mouth of neck 12 is a short cylindrical portion 13 formed with an in-turned, preferably flexible flange 14. The lip or upper surface of flange 14 is preferably smooth and horizontal. Below the cylindrical portion 13 is an inward-turned upper circumferential bead 16 having an upper downwardly-inwardly slanted shoulder 17. Below bead 16 is an outwardly-downwardly slanted conical surface 18 which terminates in a lower inturned bead 19 formed with an outward-downward slanted lower conical surface 22 which leads to a further conical surface 23 of lesser slope than surface 22. (i.e. the surface 23 is more nearly vertical than surface 22). Below surface 23 is an outward-turned bead 24 and below bead 24 is an S-curved portion 26 terminating in a breast 27 which merges with the cylindrical body of the jar 11. It will be understood that the wall thickness of neck 12 is substantially uniform throughout.

Cap 31 is formed with a circular top disk 32. Depending from disk 32 is a short cylindrical inner skirt 33 having its outer bottom edge 34 tapered. Outwardly of skirt 33 the disk 32 is preferably formed with a raised annular peripheral portion 36 from which depends outer skirt 35. Skirt 35 proceeding downwardly from raised periphery 36 comprises a cylindrial portion 37 having upper internal bead 38 at its lower end and slightly below bead 38 is a circumferential internal weakening groove 39. Below groove 39 is lower or locking internal bead 46 which has an outward-downward slanted ramp surface 47.

Pull tab 41 depends from the bottom edge 49 of skirt 35. An upper slanted internal weakening groove 42 extends from the left side of tab 41 toward intersection with groove 39. Spaced approximately 360° from slanted groove 42 is an oppositely slanted internal weakening groove 43 which continues to the bottom edge 49. Intermediate grooves 42 and 43 and depending below edge 49 is a reclosure tab 44.

Figure 3:
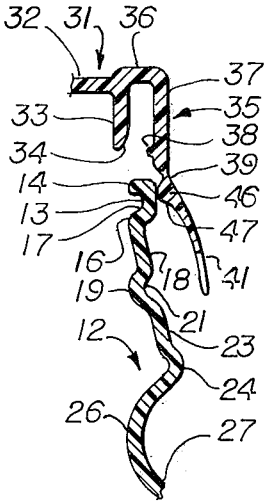
FIG. 3 is an enlarged exploded sectional view taken substantially along the lines 3—3 of FIG. 1 showing the cap in the process of being applied to the neck.

Directing attention now to FIG. 3 showing assembly of the cap 31 on neck 12, as the cap 31 is pushed downwardly slanted surface 47 distorts the skirt 35 outwardly so that bead 46 clears flange 14; and further, the rounded bead 38 subsequently clears flange 14. Slanted surface 34 on skirt 33 which, as is apparent from FIG. 3 is above the level of bead 38, causes the flange 14 to fit between the skirts 33 and 35. Surface 23 is of greater mean diameter than surface 18, bead 16 is of less mean diameter than bead 19 and bead 46 has a greater minimum inside diameter than bead 38. These dimensions assist the ramping of the cap into position.

Figure 4:
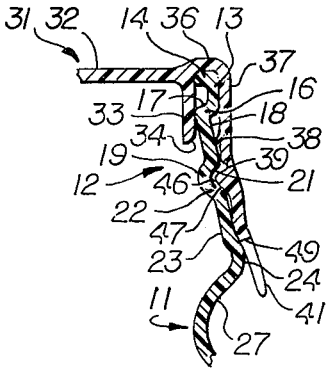
FIG. 4 is a view similar to FIG. 3 showing the cap seated on the neck.

Directing attention now to FIG. 4, it will be seen that the flange 14 is compressed between skirts 33 and 35 and the lip or upper surface of flange 14 seats against the bottom of raised periphery 36. The outer surface of cylindrical portion 13 contacts and seals against the inside of portion 37. Bead 16 is sufficiently in-turned so that it seals against the outside of inner skirt 33. Bead 38 seats against upper conical surface 18. Internal locking bead 46 seats in bead 19. Thus, there is sealing contact between cap 31 and neck 12 in three zones, namely, the contact between flange 14 and the inside of top disk 36, as well as between cylindrical portions 13 and 37. Seecondly, there is contact between bead 16 and skirt 33; and finally, there is contact between bead 38 and surface 18. The pressure of the contents of the jar 11 causes a flexing of skirt 33 outwardly improving the sealing contact between skirt 33 and bead 16. Similarly, the pressure of the contents causes an outward bending of conical surface 18 against the bead 38. In the event that contents of the container leak between the sealing surfaces 16 and 33, the pressure inside cylindrical portion 13 causes the flange 14 to bend upwardly to improve the sealing contact with the raised periphery 36. Thus, leakage of the contents of jar 11 is almost impossible even under the impact of dropping jar 11 or intense vibration during transportation.

The tamper-proof characteristics of the structure are also improved. It will be seen that bead 46 seats inside the external groove of bead 19. Further, as best shown in FIG. 1, the lower edge 49 of skirt 35 is immediately above bead 24 and thus it is extremely difficult to pry cap 31 off neck 12 without tearing the skirt as hereinafter described.

Figure 5:
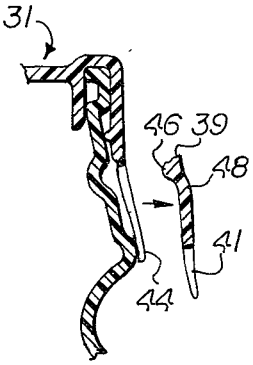
FIG. 5 is a view similar to FIG. 4 showing the tear strip removed.

In order to open the jar, the user grasps tab 41 pulling it upwardly and to the left, as viewed in FIG. 1, along weakening groove 42 and then circumferentially around groove 39 and thence down groove 43. This removes tear strip 48. After the tear strip 48 has been completely removed, the user grips reclosure tab 44, pulling upward causing bead 38 to unseat from bead 16. After dispensing a portion of the contents, the reclosure cap (i.e. that portion above groove 39) is readily reseated in position shown in FIG. 5.

It will be seen that the tabs 41, 44 extend below bead 24. By inserting the fingertips in curved portion 26 it is easy to grip tab 41 or 44 with the fingers for tearing strip 44 or removing the reclosure cap respectively.

I claim:

1. In combination, a thin-walled container neck, said neck formed with a cylindrical upper end having an inwardly-turned top flange, an inwardly-turned upper neck bead below said upper end, said upper neck bead comprising a downwardly-inwardly slanted shoulder, the inside diameters of said flange and of said upper neck bead being approximately the same, a conical outwardly-downwardly first slanted portion below said shoulder of said upper neck bead, a lower inwardly-turned neck bead below said first slanted portion, an outwardly-downwarddly second slanted portion below said lower neck bead, and an external bead below said second slanted portion; and a deformable, flexible plastic cap, said cap having a top disc having a short, depending inner skirt and a peripheral outer skirt, said outer skirt having a cylindrical upper portion parallel to said inner skirt, the spacing between said inner skirt and said cylindrical upper portion being substantially greater than the thickness of the wall of said container neck, an upper internal cap bead below said upper portion, a weakening groove below said upper internal bead and a lower internal cap bead below said weakening groove, said outer skirt being flared outwardly below said lower internal cap bead so that said cap rests in stable fashion on said neck prior to said cap being seated on said neck;

the top of said flange fitting against the underside of said disc, said flange being compressed between said inner skirt and said upper portion of said outer skirt, said upper neck bead being in sealing engagement with the outside of said inner skirt, said upper cap bead fitting in sealing engagement against said first slanted portion, said lower cap bead locking in said lower neck bead, the lower edge of said outer skirt fitting tightly against the outside of said second slanted portion of said neck and also fitting tightly against the top of said external bead of said neck so that said cap cannot be pulled off said neck by prying the lower edge of said cap upward with the fingers, the outer lower edge of said inner skirt being tapered and the bottom surfaces of both said upper and lower internal cap beads being slanted downwardly-outwardly so that downward pressure on said cap when said cap is resting on top of said neck seats said cap on said neck.

2. The combination of claim 1 in which said cap is formed with an integral pull tab extending from the bottom edge of said skirt and said outer skirt is formed with an upward, oppositely diverging second and third weakening grooves to either side of said pull tab intersecting said first-mentioned weakening groove, and a reclosure tab extending from the bottom edge of said outer skirt and extending up between said second and third weakening grooves, said first-mentioned weakening groove being interrupted between the intersections thereof with said second and third weakening grooves.

3. A deformable, flexible plastic cap for use with a thin-walled container neck, said neck formed with a cylindrical upper end having an inwardly-turned top flange, an inwardly-turned upper neck bead below said upper end, said upper neck bead comprising a downwardly-inwardly slanted shoulder, the inside diameters of said flange and of said upper neck bead being approximately the same, a conical outwardly-downwardly first slanted portion below said shoulder of said upper neck bead, a lower inwardy-turned neck bead below said first slanted portion, an outwardly-downwardly second slanted portion below said lower neck, and an external bead below said second slanted portion;

said cap comprising a top disc having a short, depending inner skirt and a peripheral outer skirt, said outer skirt having a cylindrical upper portion parallel to said inner skirt, the spacing between said inner skirt and said cylindrical upper portion being substantially greater than the thickness of the wall of said container neck, an upper internal cap bead below said upper portion, a weakening groove below said upper internal bead and a lower internal cap bead below said weakening groove, said outer skirt being flared outwardly below said lower internal cap bead so that said cap rests in stable fashion on said neck prior to said cap being seated on said neck; said inner skirt and said upper portion of said outer skirt being dimensioned and positioned so that in the assembled condition of said cap and said neck the top of said flange fits against the underside of said disc, said flange is compressed between said inner skirt and said upper portion of said outer skirt, said upper neck bead is in sealing engagement with the outside of said inner skirt, said upper cap bead fits in sealing engagement against said first slanted portion, said lower cap bead locks in said lower neck bead, the lower edge of said outer skirt fits tightly against the outside of said second slanted portion of said neck and also fits tightly against the top of said external bead of said neck so that said cap cannot be pulled off said neck by prying the lower edge of said cap upward with the fingers, the outer lower edge of said inner skirt being tapered and the bottom surfaces of both said upper and lower internal cap beads being slanted downwardly-outwardly so that downward pressure on said cap when said cap is resting on top of said neck seats said cap on said neck.

4. A cap according to claim 3 in which said cap is formed with an integral pull tab extending from the bottom edge of said skirt and said outer skirt is formed with an upward, oppositely diverging second and third weakening grooves to either side of said pull tab intersecting said first-mentioned weakening groove, and a reclosure tab extending from the bottom edge of said outer skirt and extending up between said second and third weakening grooves, said first-mentioned weakening groove being interrupted between the intersections theereof with said second and third weakening grooves.

* * * * *